US007619495B2

(12) United States Patent
Albacete et al.

(10) Patent No.: US 7,619,495 B2
(45) Date of Patent: Nov. 17, 2009

(54) BANDPASS FILTER, ELECTRONIC DEVICE INCLUDING SAID BANDPASS FILTER, AND METHOD OF PRODUCING A BANDPASS FILTER

(75) Inventors: Jordi Bonache Albacete, Barcelona (ES); Juan Jose Garcia Garcia, Barcelona (ES); Marta Gil Barba, Barcelona (ES); Juan Fernando Martin Antolin, Barcelona (ES); Josep Ignasi Cairo Molins, Barcelona (ES); Ignacio Gil Galf, Barcelona (ES)

(73) Assignee: Seiko Epson Corporation (JP)

( * ) Notice: Subject to any disclaimer, the term of this patent is extended or adjusted under 35 U.S.C. 154(b) by 91 days.

(21) Appl. No.: 11/801,094

(22) Filed: May 8, 2007

(65) Prior Publication Data

US 2007/0262834 A1 Nov. 15, 2007

(30) Foreign Application Priority Data

May 11, 2006 (EP) ..... 06113833

(51) Int. Cl.
*H01P 3/08* (2006.01)

(52) U.S. Cl. ..... 333/204; 333/118

(58) Field of Classification Search ..... 333/204, 333/219, 33, 156, 193, 118, 203
See application file for complete search history.

(56) References Cited

U.S. PATENT DOCUMENTS 5,057,803 A * 10/1991 Ooi et al. ..... 333/204
6,791,432 B2 * 9/2004 Smith et al. ..... 333/99 S
7,418,251 B2 * 8/2008 Liu ..... 455/333
2001/0038325 A1 * 11/2001 Smith et al. ..... 333/202

FOREIGN PATENT DOCUMENTS

WO WO 2004/025783 3/2004
WO WO 2006/070036 7/2006

OTHER PUBLICATIONS

Allen et al., Dual-mode composite-right/left-handed transmission line ring resonator, Jan. 19, 2006, Electronics Letters, vol. 42. No. 2.*

(Continued)

*Primary Examiner*—James H. Cho
*Assistant Examiner*—Crystal L Hammond
(74) *Attorney, Agent, or Firm*—Harness, Dickey & Pierce, P.L.C.

(57) ABSTRACT

The bandpass filter comprises transmission line comprising a conductor strip (2), and, in said transmission line, at least one bandpass filter cell, comprising at least one split-rings resonator (6, 7), inductive element (4, 41) and capacitive element (3). The bandpass filter has a frequency response in which at least one passband can be identified. The conductor strip, split-rings resonator(s), inductive element(s) and capacitive element(s) are dimensioned and arranged so that the bandpass filter, for frequencies within said passband, behaves as a left-handed transmission line for at least one range of frequencies within said passband, and as a right-handed transmission line for at least another range of frequencies within said passband, thus providing for a large bandwidth. The invention also relates to an electronic device including the filter, and to a method of producing it.

26 Claims, 8 Drawing Sheets

OTHER PUBLICATIONS

Allen et al., Design of ring resonator mode spacing and bandwidth using the phase response of composite right/left handed transmission lines, Jan. 2005, 0-7803-8846 pp. 709-712.*

Jordi Bonache, et al., "Novel Microstrip Bandpass Filters Based on Complementary Split-Ring Resonators", IEEE Transactions on Microwave Theory and Techniques, vol. 54, No. 1, pp. 265-271 (2006).

Joan Garcia-Garcia, et al., "Microwave Filters With Improved Stopband Based on Sub-Wavelength Resonators", IEEE Transactions on Microwave Theory and Techniques, vol. 53, No. 6, pp. 1997-2006 (2005).

Sungjoon Lim, et al., "Electronically-Controlled Metamaterial-Based Transmission Line as a Continuous-Scanning Leaky-Wave Antenna", IEEE MTT-S Digest, pp. 313-316 (2004).

* cited by examiner

BANDPASS FILTER, ELECTRONIC DEVICE INCLUDING SAID BANDPASS FILTER, AND METHOD OF PRODUCING A BANDPASS FILTER

FIELD OF THE INVENTION

The invention relates to the field of bandpass filters, especially to bandpass filters based on split-rings resonators and complementary split-rings resonators.

STATE OF THE ART

Bandpass filters are important components in many electronic systems, for example, in systems for radio communication. For example, the growing interest in ultra-wideband (UWB) communications (at least partly due to the fact that the corresponding spectrum of 3.1-10.6 GHz was released for unlicensed use for indoor and hand-held systems in 2002, by the U.S. Federal Communication Commission), has led to an increasing focus on UWB components and systems. One of the essential components of UWB systems is the UWB bandpass filter, which should feature an adequate bandwidth and, of course, adequate blocking characteristics outside the relevant band. Also, the filter must have reasonably small dimensions. This also applies to bandpass filters outside the UWB domain.

Different approaches have been tried. For example, Hand Wang, et al., "*Ultra-Wideband Bandpass Filter With Hybrid Microstrip/CPW Structure", IEEE Microwave and Wireless Components Letters*, Vol. 15, No. 12, Dec. 2005, discloses a UWB bandpass filter based on a hybrid microstrip and coplanar waveguide structure.

Other attempts are based on so-called split-rings resonators (SRRs) or complementary split-rings resonators (CSRRs). With these kind of particles, combined with other elements (such as capacitances and inductances), it is possible to implement left-handed and right-handed transmission media. A left-handed medium is characterised in that it presents an electrical field vector (E), magnetic field vector (H) and propagation vector (k) left-handed triplet, instead of a right-handed triplet presented by conventional propagation media, that is, right-handed media (cf., for example, V. G. Veselago, "*The electrodynamics of substances with simultaneously negative values of* $\epsilon$ *and* $\mu$*", Sov. Phys. Usp.* Vol. 10, No. 4, pp. 509-514, January-February 1968).

For example, Jordi Bonache, et al., "*Microstrip Bandpass Filters with Wide Bandwidth and Compact Dimensions", Microwave and Optical Technology Letters*, Vol. 46, No. 4, Aug. 20, 2005, discloses one example of a CSRR based bandpass filter with small dimensions, to be implemented in microstrip technology. The filter has a topology based on a cell comprising a CSRR (or, more specifically, a double-slit CSRR, that is, a DS-CSRR) etched in a ground plane, and separated by a dielectric layer from a conducting structure comprising a conductor strip connected to the ground plane by so-called grounded stubs. The general topology of an individual filter cell is shown in FIG. 1*a*. The filter works in a "right-handed configuration" (that is, it acts as a conventional propagation medium), with an equivalent-circuit model (shown in FIG. 1*b*) comprising an inductance corresponding to the conductor strip, represented by the two inductances "L/2" in FIG. 1*b* and, between said two inductances, a connection to ground comprising, in parallel, an inductance ($L_p$) (corresponding to the inductance of the stub pair) and a circuit that comprises, in series, a capacitance ($C_c$) (corresponding to the line-to-ground capacitance) and a so-called resonant tank, comprising a capacitance ($C_r$) and an inductance ($L_r$) arranged in parallel and corresponding to the DS-CSRR tank. This layout is alleged to provide for a filter having a small size and suitable for applications requiring wide bandwidths.

An alternative, left-handed configuration is known from Jordi Bonache, et al., "*Novel Microstrip Bandpass Filters Based on Complementary Split-Ring Resonators*", which discloses a plurality of cells acting as a left-handed transmission line with controllable bandwidth. Each cell comprises a CSRR on one side of a dielectric layer (the CSRR is etched in the ground plane of a microstrip) and, on the other side, a conductor strip interrupted by two gaps (and having a substantially increased width at the gaps, for increased capacitance), and a shunt metallic wire connected to the conductor line between the gaps, said shunt metallic wire being grounded by means of vias, thus constituting a so-called "stub pair". The general topology of an individual filter cell is shown in FIG. 2*a*. The equivalent-circuit model (shown in FIG. 2*b*) of this cell comprises two capacitances ($2C_s$) (corresponding the gaps in the conductor strip) and, between said two capacitances, a connection to ground comprising, in parallel, an inductance (a shunt inductance -$L_p$- corresponding to the inductance of the grounded stubs) and a circuit that comprises, in series, a capacitance ($C_c$) (corresponding to the line-to-ground capacitance, or, more exactly, corresponding to a capacitance that depends on the portion of the intermetallic region between the series gaps that lies face-to-face to the metal inside the inner slot of the CSRR) and a so-called LC resonant tank, comprising a capacitance ($C_r$) and an inductance ($L_r$) in parallel (and corresponding to the CSRR). It is stated that electrically small devices can be obtained, and that by combining CSRRs with series gaps, bandpass structures with backward (or left-handed) wave propagation can be achieved.

It is further disclosed how at the central frequency $f_0$ of the circuit, the image impedance (or Bloch impedance, $Z_B$) should coincide with the reference impedance at the ports, which is usually set to $Z_0$=50 Ohms. Now, considering the circuit shown in FIG. 2*b*, and assuming that it can be described by its T-circuit model, with series impedance $Z_s$ and shunt impedance $Z_p$ (as shown in FIG. 2*c*), it is stated that at $f_0$, the following condition should prevail:

$$Z_s=-jZ_0 \text{ and } Z_p=jZ_0$$

This is necessary in order to provide a phase shift between the input and output ports of the basic cell corresponding to $\phi=90°$.

It is stated that the dual solution ($Z_s=jZ_0$ and $Z_p=-jZ_0$) is not compatible with the capacitive series impedance of the circuit. It is further stated that at the central frequency of the filter, the series reactance is negative (that is, capacitive), while the shunt reactance (corresponding to the parallel combination of $L_p$ and the impedance of the CSSR coupled to the line) is positive (that is, inductive). Thus, a periodic structure composed of this type of cells will behave as a left-handed transmission line. The document further describes how suitable element values can be calculated.

Further examples of CSRRs-based bandpass filters are disclosed in Jordi Bonache, et al., "*Ultra Wide Band Pass Filters (UWBPF) Based on Complementary Split Ring Resonators", Microwave and Optical Technology Letters*, Vol. 46, No. 3, pp. 283-286, Aug. 5, 2005.

Now, it has been found that these left-hand approaches and right-hand approaches, although they may provide a suitable frequency response for many applications, are not always adequate. For example, it has been found that they may not always provide an adequate bandpass character.

DESCRIPTION OF THE INVENTION

One aspect of the invention relates to a bandpass filter, based on or comprising a planar transmission medium (such as, for example, a microstrip, a coplanar waveguide, a stripline or similar) comprising a transmission line, said transmission line comprising at least one conductor strip. The bandpass filter has, in said transmission line, at least one bandpass filter cell, said filter cell comprising at least one split-rings resonator (such as, for example, a split-rings resonator, a complementary split-rings resonator or a double-slit complementary split-rings resonator), at least one inductive element (such as, for example, a stub connecting the conductor strip to ground) and at least one capacitive element (such as, for example, a gap in the conductor strip). The bandpass filter has a frequency response in which at least one passband can be identified.

In accordance with the invention, said conductor strip, said at least one split-rings resonator, said at least one inductive element and said at least one capacitive element are dimensioned and arranged so that the bandpass filter, for frequencies within said passband, behaves as a left-handed transmission line for at least one range of frequencies within said passband, and as a right-handed transmission line for at least another range of frequencies within said passband.

Thus, a filter having small dimensions and featuring a large bandwidth can be obtained.

Until now, split-rings resonator based prior art bandpass filters have been designed to function in the right-handed mode or in the left-handed mode. Of course, basically, the general "equivalent-circuit" diagram of the present circuit can be considered to be similar to some prior art ones mentioned above. However, in these prior art circuits, designed to provide for a passband in correspondence with the right-handed or left-handed transmission mode, the conductor strips are not dimensioned so as to provide an inductance that, in combination with the other inductances and capacitances of the circuit, causes it to operate in the left-handed mode for frequencies corresponding to one part of the passband, and in the right-handed mode for frequencies corresponding to another part of the same passband. By setting the inductance accordingly, that is, for example, by considering the conductor strip inductance a relevant value to be set in the design of the filter, as representing one degree of freedom of the design, together with the selection of the configuration (including selection of dimensions) of the inductive element(s) (such as stubs), the configuration of the capacitive elements (such as the gap(s)), and the configuration of the parts making up the split-rings resonator(s)), it is achieved that the behaviour of the filter can change from the left-handed mode to the right-handed mode within the passband (that is, without any rejecting band between the part of the passband corresponding to the left-handed mode and the part of the passband corresponding to the right-handed mode). This situation corresponds to the balanced mode (i.e., series and shunt resonance frequencies corresponding to $Z_s$ and $Z_p$ are identical, see below). Thus, it is achieved that, within the same passband, and considering the T equivalent circuit of the filter cell, having a series impedance $Z_s$ and a shunt impedance $Z_p$, the filter further having a Bloch impedance $Z_B$:

I)—there is a reflection zero (that is, a transmission peak), corresponding to the resonance mode (in which the series impedance $Z_s$ of the cells—in accordance to their T-model—is zero ($Z_s=0$) and the shunt impedance $Z_p$ of the cells becomes infinite ($Z_p=\infty$) simultaneously). At that frequency, the phase corresponds to zero. At that frequency, the impedance signs change simultaneously for $Z_s$ and $Z_p$, that is, the condition $Z_s<0$, $Z_p>0$ (left-handed transmission) changes directly to $Z_s>0$, $Z_p<0$ (right-handed transmission).

II)—there are frequencies for which the filter operates in the left-handed transmission mode ($Z_s<0$; $Z_p>0$); further, the Bloch impedance $Z_B$ can optionally match the impedance at the ports of the filter (typically 50 Ohms), in which case a further reflection zero (transmission peak) per filter cell is provided within the passband, thus providing for a wider passband.

III)—there are frequencies for which the filter operates in the right-handed transmission mode ($Z_s>0$; $Z_p<0$); further, the Bloch impedance $Z_B$ can optionally match the impedance at the ports of the filter (typically 50 Ohms), in which case a further reflection zero per filter cell (transmission peak) is provided within the passband, thus providing for a wider passband.

An optimally wide passband can be obtained when the three reflection zeros per filter cell are all situated within the passband. Hereby, a wider passband can be obtained, while guaranteeing a good suppression of the signal above the upper limit and below the lower limit of the passband. Of course, also prior art filters using the split-rings resonator technology can be operated both in the left-handed mode and in the right-handed mode, but not within the same passband, that is, within a band that is not substantially interrupted by a stopband. Hence, according to the invention, the transition between the left-handed mode and the right-handed mode is produced in a continuous way, i.e. the resonances corresponding to $Z_s$ and $Z_p$ are produced at the same frequency. Thus, a simultaneous change of sign is produced in $Z_s$ and $1/Z_p$ and no bandstops occur within the passband.

The left-handed mode corresponds to a capacitive series impedance and an inductive shunt impedance behaviour, and the right-handed mode corresponds to an inductive series impedance and a capacitive shunt impedance behaviour.

Explained in another way, by means of the invention, up to three reflection zeros (that is, three peaks of maximum transmission) can be obtained for each stage or cell of the filter and for at least one passband, whereas in normal bandpass filters, operating in the right-handed mode or in the left-handed mode, normally only one such peak per stage is present within the passband.

The effect produced by the invention is obtained by adjusting the dimensions of the intervening elements (conductor strip, gap(s), stub(s), split-rings resonator(s), etc.) so that, within the passband, the following conditions are complied with ($Z_s$ is the series impedance and $Z_p$ is the shunt impedance of a T model of the filter cell (cf., for example, FIG. 6*b*), whereas $Z_B$ is the so-called Bloch impedance):

i) $Z_s<0$ and $Z_p>0$ (this corresponds to the left-handed mode) (in order to produce a corresponding transmission peak, the filter cells could further be designed to cause the Bloch impedance to match the impedance at the ports of the filter, typically 50 Ohms)

ii) $Z_s=0$ and $Z_p=\infty$(this corresponds to the zone of impedance resonance, where the structure provides for total transmission of the signal, by definition)

iii) $Z_s>0$ and $Z_p<0$ (this corresponds to the right-handed mode) (in order to produce a corresponding transmission peak, the filter cells could further be designed to cause the Bloch impedance to match the impedance at the ports of the filter, typically 50 Ohms).

Along the passband (that is, for every frequency within the passband), one of these conditions should be complied with, whereby no stopband will be present. Concerning conditions i) and iii), if the Bloch impedance is not matched (that is, normally, if said Bloch impedance is not equal to the impedance at the ports of the filter, typically 50 Ohms), there may be no corresponding reflection zero within the passband, whereby the width of the passband may be reduced to a certain extent (however, it may still offer a sufficient bandwidth for many practical applications).

The phase shift Φ of a cell and its Bloch impedance are defined as follows (with reference to the T model mentioned above):

$$\cos\phi = 1 + \frac{Z_S(j\omega)}{Z_P(j\omega)}$$

$$Z_B(j\omega) = \sqrt{Z_S(j\omega)[Z_S(j\omega) + 2Z_P(j\omega)]}$$

Transmission occurs when both values (Φ and $Z_B$) are real. The conditions of matching are fulfilled when $Z_B=Z_o$, where $Z_o$ is the characteristic impedance, which normally is set to 50 Ohms. Thus, according to the above formulae, for the conditions of matching to be fulfilled, the following conditions should prevail:

Zs<0 and Zp>0 (left-handed mode)

Zs>0 and Zp<0 (right-handed mode)

The first condition corresponds to a substantially capacitive series impedance (which can be determined, for example, by the capacitance of the gap(s) in the transmission line) and a substantially inductive shunt impedance. This kind of structure behaves as a metamaterial (that is, an artificial material, not found in the nature) that is an effectively-homogeneous (the structural cell unit is much smaller than the wavelength of the transmitted signal) electromagnetic material. By repeating the cell periodically, the structure behaves as a left-handed transmission line, and supports so-called backward waves (cf., for example, G. V. Eleftheriades, A. K. Iyer, and P. C. Kremer, "*Planar negative refractive index media using L-C loaded transmission lines", IEEE Trans. Microw. Theory Tech.*, vol. 50, no. 12, pp. 2702-2712, December 2002). On the other hand, in the right-handed mode, the cell will comprise a substantially inductive series impedance (dominated by the inductance of the transmission line) and a substantially capacitive shunt impedance. A periodic structure of this type corresponds to a right-handed transmission line.

As explained above, in order to provide for a very large bandwidth of the passband, both propagation modes are to occur within the passband, in a continuous manner, that is, without any substantial intervening stopband. This is known as the balanced mode, wherein the resonances corresponding to the series impedance ($Z_s$) and the shunt impedance ($Z_p$) resonate at substantially the same frequency. Thus, at the central minimum of reflection ($Z_s=0$; $Z_p=\infty$), there is a simultaneous change in the sign (positive/negative) in $Z_s$ y $1/Z_p$. If this condition is not fulfilled, that is, if there is, within a frequency band, an area where the series impedance and the shunt impedance have the same sign, according to the above equation there will be a "stopband" within the frequency band, as there will be no propagation of the signal (as no real value of Φ can be obtained). Thus, no wide passband is obtained. This is what occurs in many prior art filters.

In accordance with the invention, said at least one cell thus features a T equivalent circuit having a series impedance and a shunt impedance, wherein, for one frequency band within a passband of the bandpass filter, the series impedance of the cell is negative and the shunt impedance is positive, wherein, for another frequency band within the same passband, the series impedance of the cell is positive and the shunt impedance is negative, and wherein, at a frequency between said frequency bands, the series impedance is substantially null and the shunt impedance is substantially infinite (in this definition, ohmic losses have been disregarded).

Optionally, within one or both of said two frequency bands, there is a frequency at which the Bloch impedance of the cell is matched with the impedance at the ports of the filter (for example, the Bloch impedance can be matched to 50 Ohms, the typical impedance at the ports of the filter).

Said at least one bandpass filter cell can, for example, feature three reflection zeros within the passband.

Said at least one split-rings resonator can be a complementary split-rings resonator, that is, it can comprise non-metallic split rings established in at least one metal part of the transmission line, such as in one or more metal layers thereof (for example, in the ground plane of the transmission line).

The conductor strip can, for example, further comprises at least one gap in said cell, said at least one gap constituting said capacitive element.

Said at least one inductive element can, for example, comprise at least one conducting stub situated in correspondence with said gap and connecting the conductor strip to a metal layer (such as a ground plane of the transmission line) (in which said at least one complementary split-rings resonator can be formed), through a dielectric layer.

Said at least one complementary split-rings resonator can comprise split rings etched in said metal layer (such as a ground plane) on one side of said dielectric layer, and said conductor strip can be embodied on the other side of said dielectric layer. Said at least one stub can be arranged in correspondence with said at least one gap, and said at least one stub can be connected to the metal layer by vias through the dielectric layer.

Said at least one gap can comprise at least two gaps, and said at least one stub can comprise at least two stubs connected to the conductor strip between said two gaps.

As an alternative, the complementary split-rings resonator (s) can also be etched in the conductor strip.

As an alternative, said at least one split-rings resonator can be a metallic split-rings resonator, comprising metallic rings, a magnetic coupling being provided between the conductor strip and said at least one split-rings resonator.

The split-rings resonators can be embodied in many alternative ways. For example,

- they can comprise split rings having a substantially circular shape, or an oval shape, or a polygonal shape;
- they can comprise split rings featuring one or more "slits" in each ring ("metal slits" in the case of a complementary split-rings resonator, or "non-metallic slits" in the case of a split-rings resonator based on metallic rings; for example, a conventional DS-CSRR features two "metallic slits" in each no-metallic ring);
- they can comprise one or more metallic and/or non-metallic elements arranged in a plurality of different layers of the transmission line.

Said at least one passband of the bandpass filter can feature a fractional bandwidth of at least 20%, said fractional bandwidth being defined as 2*(fu−fl)/(fu+fl)) where fu is an upper −10 dB frequency limit of the passband, and fl is a lower −10 dB frequency limit of the passband.

Said at least one passband can have a bandwidth of at least 500 MHz between an upper and a lower −10 dB frequency limit.

Said at least one passband can have a lower −10 dB frequency limit not above 4 GHz and an upper −10 dB frequency limit not below 9 GHz.

The bandpass filter can comprise a plurality of said filter cells, arranged in a cascade so that a transmitted signal passes through said plurality of filter cells.

The bandpass filter can be embodied on a dielectric substrate having a thickness lower than 150 μm (for example, in the order of 127 μm). This low thickness has been found to be appropriate for obtaining a high rejection outside the passband. This is due to the necessity to minimize substrate waves between input and output ports. These undesired substrate waves depend on the frequency and on the thickness of the dielectric substrate.

Another aspect of the invention relates to an electronic device including at least one bandpass filter as described above, such as an electronic circuit for radio transmission and/or reception (for example, an electronic circuit for a UWB transmitter or receiver), or a device including such a circuit, such as a UWB transmitter or receiver.

Another aspect of the invention relates to a method of producing a bandpass filter based on a planar transmission medium. The method comprises the step of establishing a transmission line comprising a conductor strip and, in said transmission line, at least one bandpass filter cell comprising at least one split-rings resonator, at least one inductive element and at least one capacitive element, so that a bandpass filter is obtained having a frequency response in which at least one passband can be identified.

In accordance with the invention, the step of establishing said transmission line is carried out so that said conductor strip, said at least one split-rings resonator, said at least one inductive element and said at least one capacitive element are dimensioned and arranged so that the bandpass filter, for frequencies within said passband, behaves as a left-handed transmission line for at least one range of frequencies within said passband, and as a right-handed transmission line for at least another range of frequencies within said passband.

What has been stated above with regard to the filter is also applicable to the method of producing a filter, *mutatis mutandis*.

For example, said conductor strip, said at least one split-rings resonator, said at least one inductive element and said at least one capacitive element are dimensioned and arranged so that said at least one cell features a T equivalent circuit having a series impedance and a shunt impedance, wherein, for one frequency band within a passband of the bandpass filter, the series impedance of the cell is negative and the shunt impedance is positive, wherein, for another frequency band within the same passband, the series impedance of the cell is positive and the shunt impedance is negative, and wherein, at a frequency between said frequency bands, the series impedance is substantially null and the shunt impedance is substantially infinite.

Said at least one split-rings resonator can be embodied as a complementary split-rings resonator.

Said at least one gap can be provided in the conductor strip in said at least one cell, and said at least one gap can constitute said capacitive element.

Said at least one inductive element can be provided by establishing at least one conducting stub situated in correspondence with said gap and connecting the conductor strip to a metal layer in which said at least one complementary split-rings resonator is formed, through a dielectric layer.

The method can comprise the step of establishing said at least one complementary split-rings resonator by etching split rings in said metal layer on one side of said dielectric layer, while said conductor strip can be embodied on the other side of said dielectric layer. It can also comprise the step of establishing said at least one stub in correspondence with said at least one gap, and connecting said at least one stub to the metal layer by vias through said dielectric layer.

BRIEF DESCRIPTION OF THE DRAWINGS

To complete the description and in order to provide for a better understanding of the invention, a set of drawings is provided. Said drawings form an integral part of the description and illustrate preferred embodiments of the invention, which should not be interpreted as restricting the scope of the invention, but just as examples of how the invention can be embodied. The drawings comprise the following figures.

DESCRIPTION OF A PREFERRED EMBODIMENT OF THE INVENTION

Figure 1A:
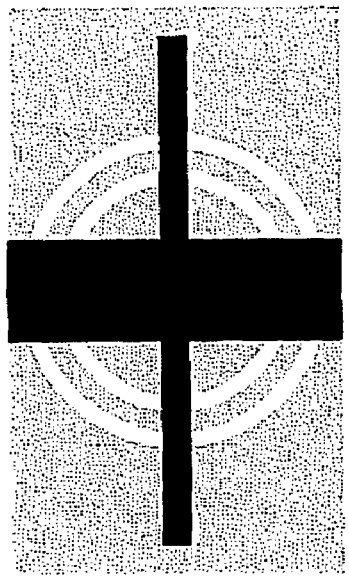
FIGS. 1*a* and 1*b* illustrate a prior art filter cell, namely, its topology and its equivalent-circuit model, respectively.
Figure 1B:
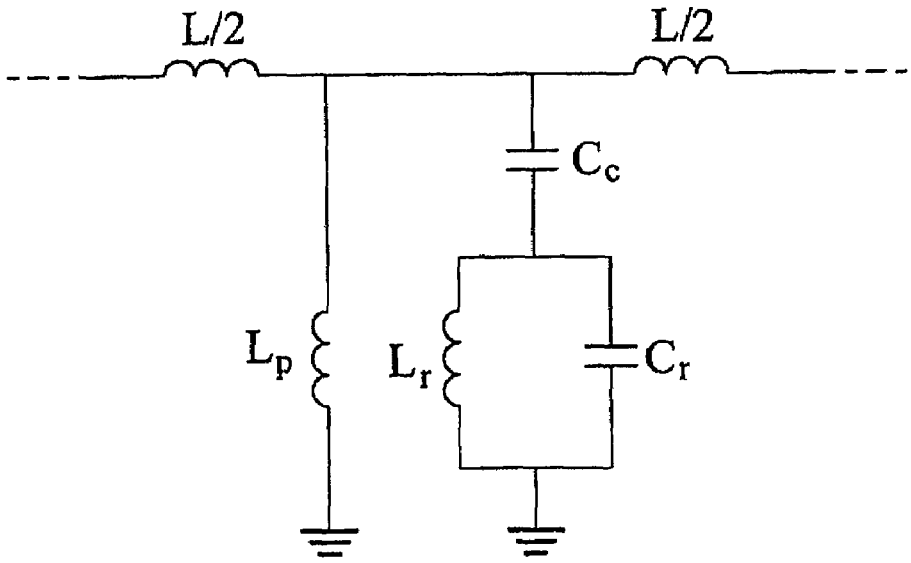
Figure 2A:
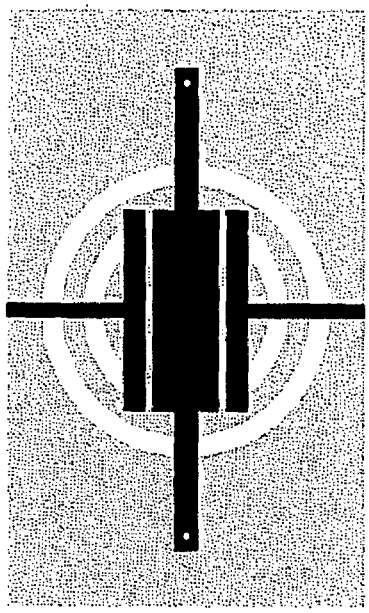
FIGS. 2*a*, 2*b* and 2*c* illustrate another prior art filter cell, namely, its topology, its equivalent-circuit model and its T-model, respectively.
Figure 2B:
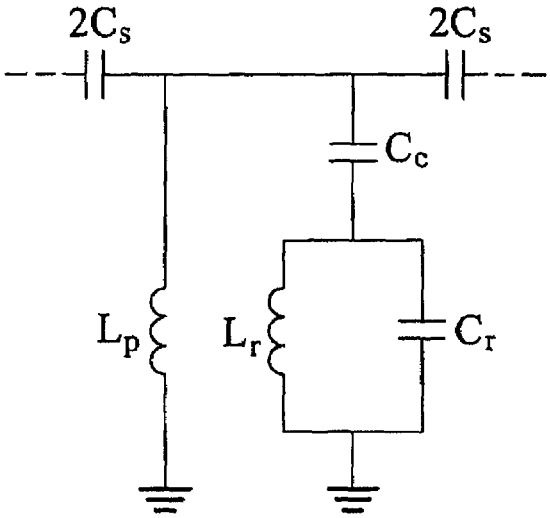
Figure 2C:
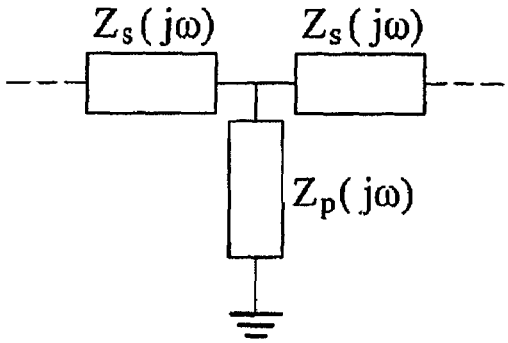
Figure 3A:
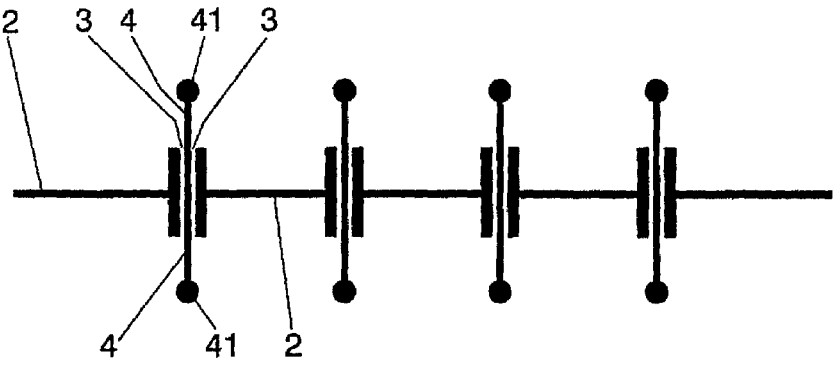
FIGS. 3*a*-3*c* schematically illustrate the topology of a bandpass filter comprising four filter cells, in accordance with a preferred embodiment of the invention.
Figure 3B:
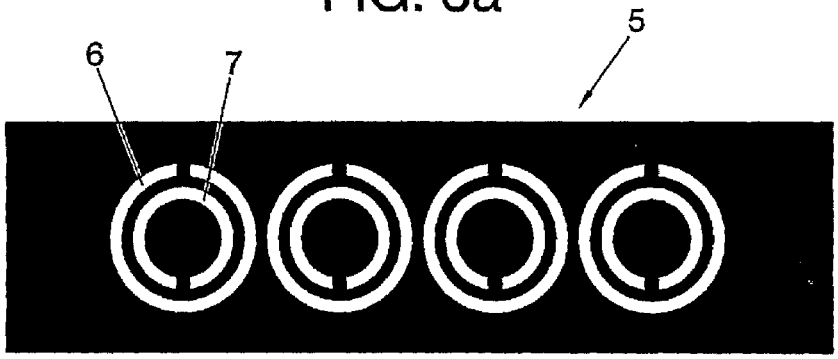
Figure 3C:
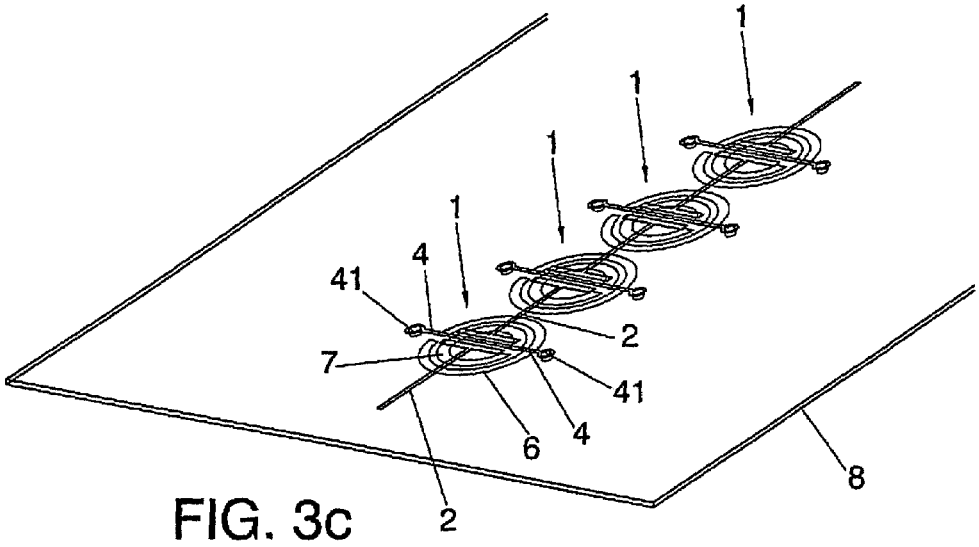
Figure 4:
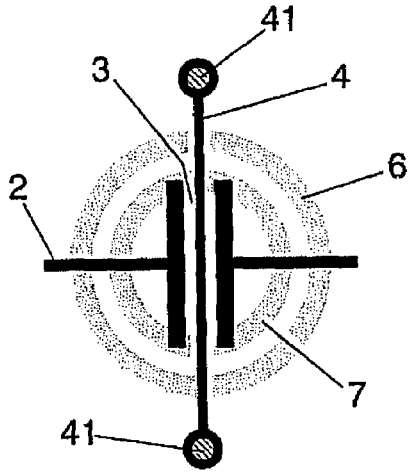
FIG. 4 schematically illustrates the topology of a filter cell in accordance with a preferred embodiment of the invention.

In accordance with one possible embodiment of the invention, a bandpass filter is provided, embodied as illustrated in FIGS. 3*a*-3*c*. The filter comprises four filter cells 1, situated in a microstrip transmission line comprising a conductor strip 2 and a ground plane 5. In each filter cell, the conductor strip 2 is interrupted by two capacitive gaps 3. A metallic stub pair 4 is located between the two gaps, said stub pair 4 connecting the conductor strip 2 to ground through vias 41, which pass through the dielectric layer 8 separating one layer of the transmission line structure (said layer being illustrated in FIG. 3*a* and comprising conductor strip 2, gaps 3 and stubs 4), and reach the metal ground plane 5 illustrated in FIG. 3*b* and in which the split rings 6, 7 are etched (these split rings constitute conventional complementary split rings resonators (CSRRs)). The vias 41 connecting the stubs 4 to the ground plane can also be observed in FIG. 3*c*. This basic topology is well-known in the art, cf. for example the above cited prior art references. In the preferred embodiments disclosed herein, the filter cells are implemented on a Rogers RO3010 substrate having a dielectric constant of $\epsilon_r$=10.2 and a thickness of 127 μm. In FIG. 4, a top view of a filter cell can be observed, in which the conductor strip 2 with the gaps 3 and stubs 4 are in the top layer, and the complementary split rings 6 and 7 are etched in the bottom layer (the ground plane 5) of the substrate, separated by the dielectric layer 8. In FIGS. 3*a* and 4, for example, it is easily observed how the conductor strip is substantially wider at the ends facing the gaps, thus increasing the capacitance of the gaps.

Figure 10:
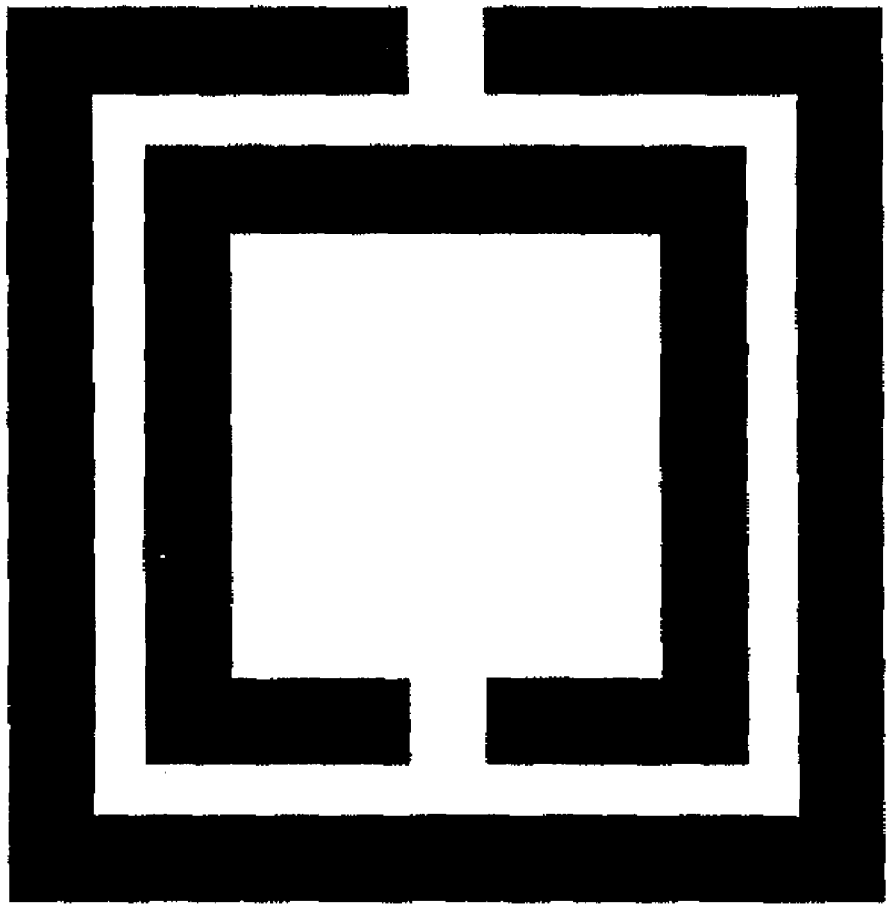
FIG. 10 illustrates an alternative split-rings resonator layout.

This band-pass filter is implemented in microstrip technology. Other embodiments can use a coplanar waveguide or other similar techniques as a basis for the implementation of the filter. Also other types and implementations of the split-rings resonators can be used. For example, complementary split-rings resonators could be etched in the conductor strip. Instead of using complementary split-rings resonators, other split rings resonators can be used, such as the SRRs (that is, metallic split rings resonators) or DS-CSRRs mentioned above. The split-rings resonators can be implemented in one or more layers of the structure. The rings are not necessarily circular, also other topologies can be used, for example, split-rings resonators based on polygonal or oval ring geometries, and having one or more slits (a split-rings resonator layout based on polygonal rings is schematically illustrated in FIG. 10).

Figure 5A:
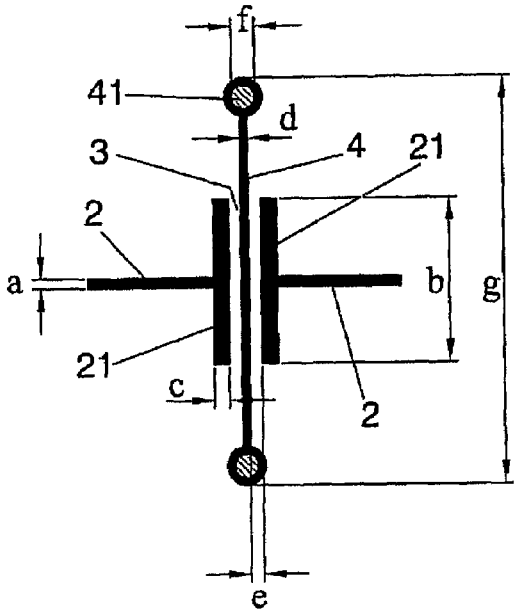
FIGS. 5*a* and 5*b* illustrate the components of said filter cell more in detail.
Figure 5B:
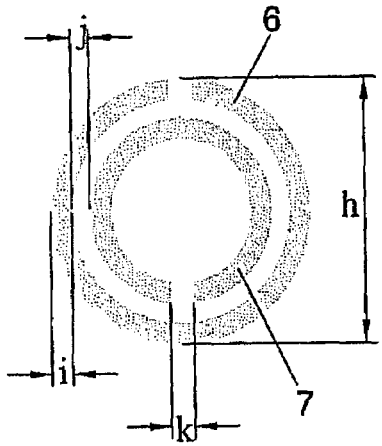

FIGS. 5*a* and 5*b* illustrate the relative dimensions of the different parts making up the filter cell, and the following values have been found to be appropriate for wide-band implementations suitable for UWB transmission, when implemented on the above-mentioned substrate:

The conductor strip has a general width "a" of 0.13 mm, which increases to a width "b" of 2.0 mm at the gaps, establishing the corresponding capacitive plates 21 having the dimensions b (2.0 mm as stated above)×c (0.21 mm). The shunt stub 4 has a width of d=0.1 mm, and is separated from each of the capacitor plates 21 by a distance of e=0.15 mm. The vias 41 have diameters of 0.3 mm, and the distance between the outer ends of the vias, which distance determines the physical height of the cell, is 5.0 mm.

On the other hand, the outer diameter of the complementary split ring assembly (namely, the outer diameter of the outer ring) is h=3.3 mm, each ring has a thickness of i=0.3 mm, and the inner ring 7 is separated from the outer ring 6 by a metallic gap having a width of j=0.19 mm. Each ring is split by a gap having a length of k=0.3 mm.

The thickness of each of the metal parts is 35 μm.

Figure 6A:
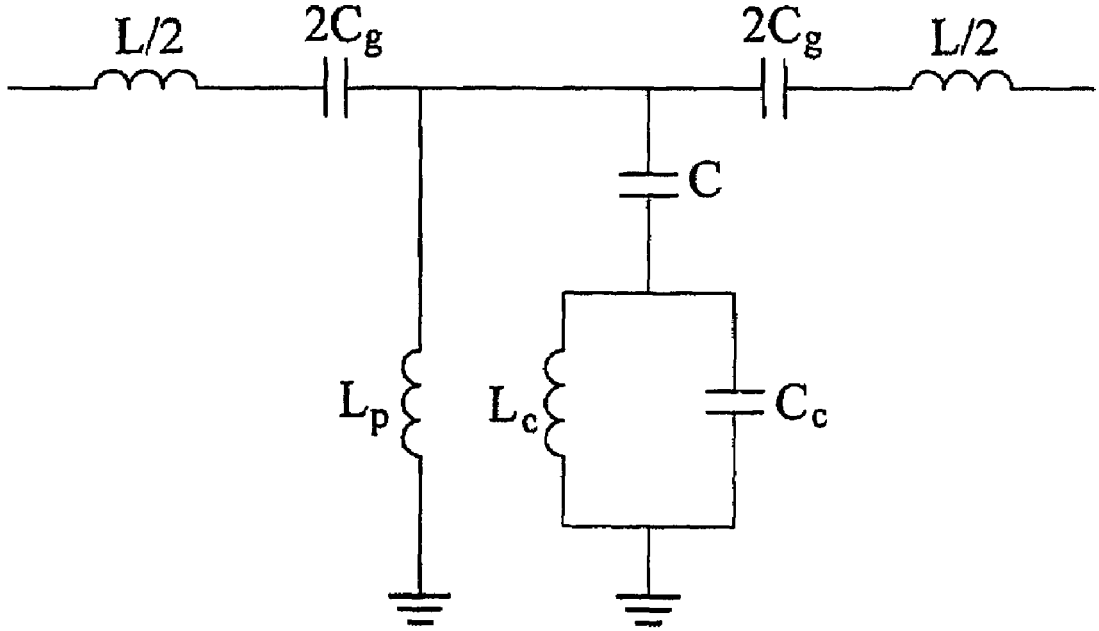
FIGS. 6*a* and 6*b* illustrate the equivalent-circuit model and the T-model, respectively, of said filter cell.

FIG. 6A schematically illustrates the equivalent-circuit model of this filter cell, whereby the complementary split-rings resonator corresponds to the resonant tank comprising the inductance "$L_c$" and the capacitance "$C_c$" arranged in parallel; "C" corresponds to the electrical coupling capacitance between the conductor strip and the CSRR. "$L_p$" represents the inductance of the stubs, between the conductor strip and ground. In the conductor strip, the total capacitance of the gaps is represented as "$C_g$", whereas "L" is the inductance of the conductor strip, which substantially depends on the width of the conductor strip section, which should be carefully chosen in order to obtain the desired frequency response.

To set the relevant parameters starting from the general topology of the circuit as described above and in order to obtain a desired frequency response, the skilled person can easily obtain a suitable result by applying the teachings of the present disclosure (including the description of the left-handed mode and the right-handed mode) and arrive at a suitable result without need to exercise any inventive skill or substantial effort. In order to set the parameters of the cell and filter correctly, commercially available software such as Agilent Momentum, Agilent ADS, Ansoft HFSS, etc., can be used. The width of the transmission line should be considered in this context, due to its contribution to the impedance of the circuit.

Figure 6B:
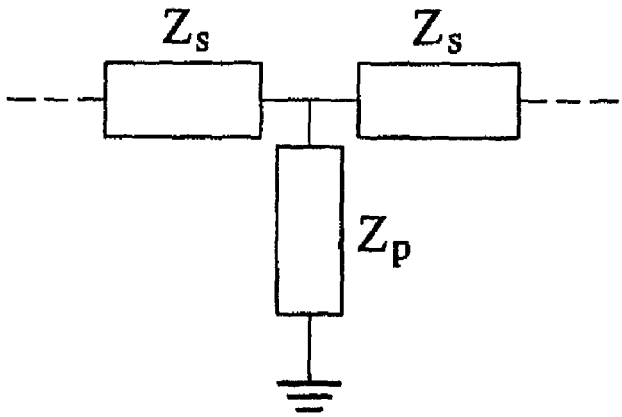

FIG. 6*b* schematically illustrates the T-model of the circuit of FIG. 6*a*. The filter cell has been designed in order to work in the balanced mode, where the series and shunt resonance frequencies are identical. In that case the backward wave propagation region (the left-handed one) and the forward wave propagation region (the right-handed one) are continuous (that is, not separated by any stopband).

Figure 7:
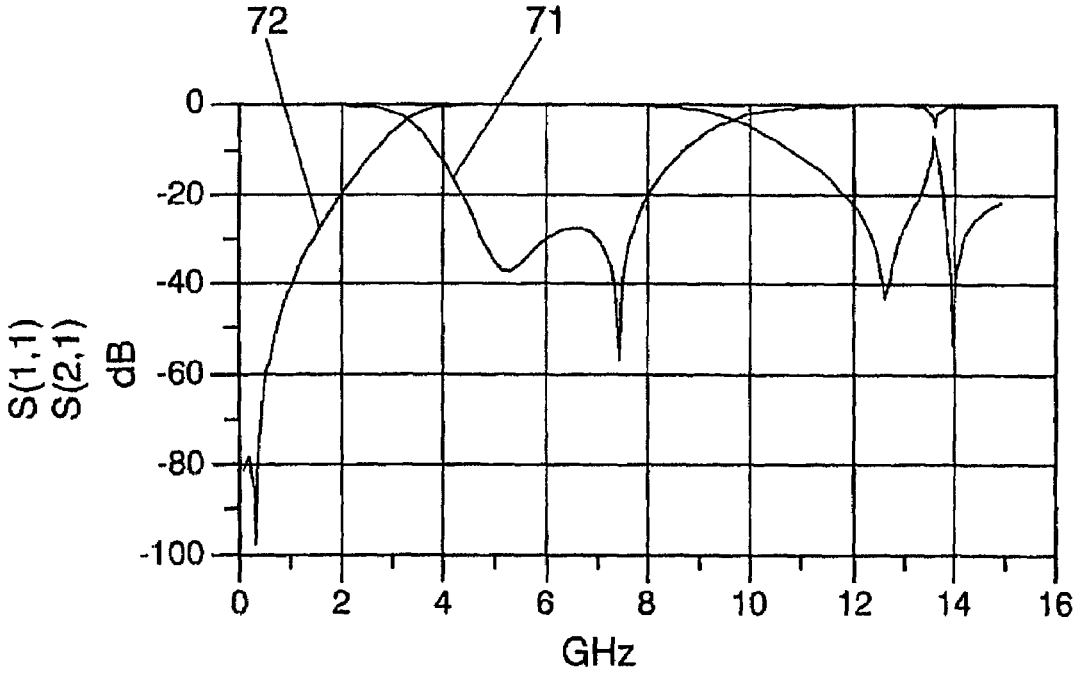
FIG. 7 illustrate the frequency response in accordance with an electromagnetic layout level simulation of a filter cell in accordance with the layout of FIG. 4-5*b*.

FIG. 7 schematically illustrates the results of a electromagnetic layout level simulation of the frequency response of the filter cell described in connection with FIGS. 4-5*b*, with its reflection coefficient (S(1,1)) 71 and its transmission coefficient (S(2,1)) 72. It can be observed that the insertion losses (S(2,1)) show an ultra-wideband response (the fractional bandwidth being higher than 60%), although only one filter cell has been used. On the other hand, the return losses illustrate a behaviour under 20 dB for zero reflection (transmission peaks). The metal losses have been disregarded in the simulation.

Figure 8:
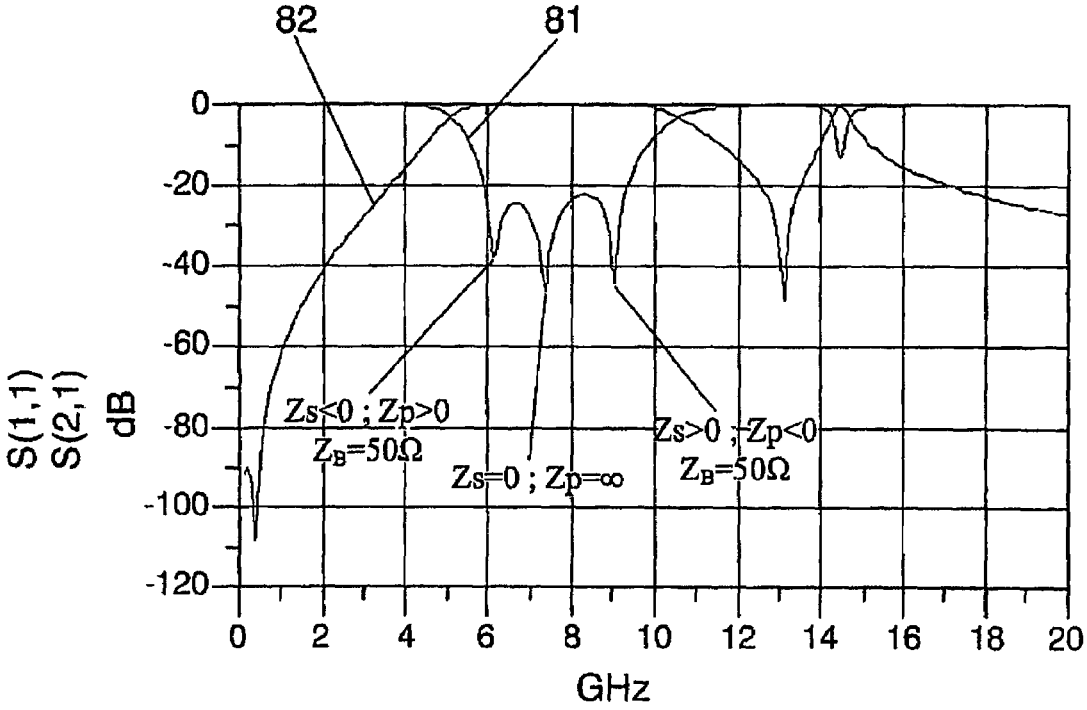
FIG. 8 illustrates the frequency response of such a filter cell, according to an electric equivalent-circuit level simulation performed on the basis of the equivalent-circuit model of FIG. 6*a*.

FIG. 8 schematically illustrates the frequency response, namely, the reflection coefficient 81 and the transmission coefficient 82, corresponding to the equivalent-circuit of FIG. 5*a*, according to an electric equivalent-circuit level simulation. The frequency response behaviour is essentially the same as that illustrated in FIG. 7. However, in the equivalent-circuit case, the lumped parameters have been adjusted in order to present an optimal situation, that is, the presence of three reflection zeros (transmission peaks) per filter stage or cell. In the balanced mode, which is the case here, the transmission coefficient exhibits a reflection zero. This is due to the zero-phase at the transition frequency between left-handed and the right-handed bands. On the other hand, the design of topologies with phase and impedance matching is possible if the characteristic impedance is equal to the impedance at the ports of the filter (typically 50 Ohms) in the passband. That case corresponds to a "no reflections" situation and thus implies total transmission (due to this matching impedance condition). In the case of periodic structures (as in the filter described here), the characteristic impedance is determined by the Bloch impedance, $Z_B$. That is, in order to achieve impedance matching, $Z_B$ must be equal to the impedance at the ports of the filter. Then, it is possible to obtain more than one reflection zero (namely, two or up to three reflection zeros or transmission peaks) per filter cell within the passband. In FIG. 8, three peaks corresponding to reflection zeros can be observed. One of them corresponds to the frequency for which the Bloch impedance $Z_B$=50 Ohms in the left-handed zone (where $Z_s$<0 and $Z_p$>0), another one of the peaks corresponds to the frequency for which the block impedance $Z_B$=50 Ohms in the right-handed zone (where $Z_s$>0 and $Z_p$<0), and the central one of them corresponds to the frequency for which $Z_s$=0 and $Z_p$=∞. These electrical simulations have been developed using Agilent ADS and by fitting electrical parameters in order to set the filter cell in the balanced mode.

Figure 9A:
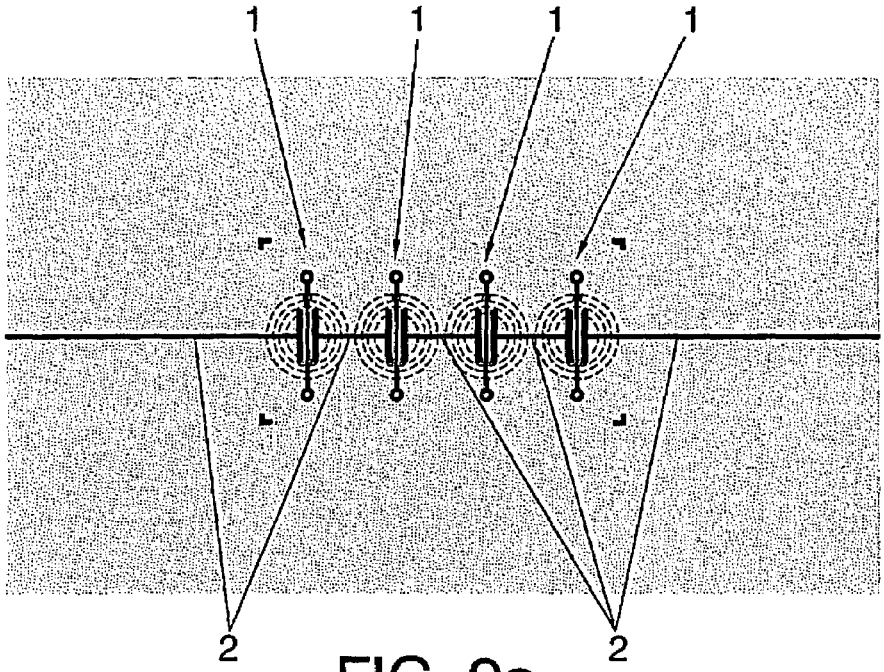
FIGS. 9*a* and 9*b* show a top view and frequency response, respectively, of the filter illustrated in FIGS. 3*a*-3*c*, with filter cells as per FIGS. 4-5*b*, as measured on a prototype.
Figure 9B:
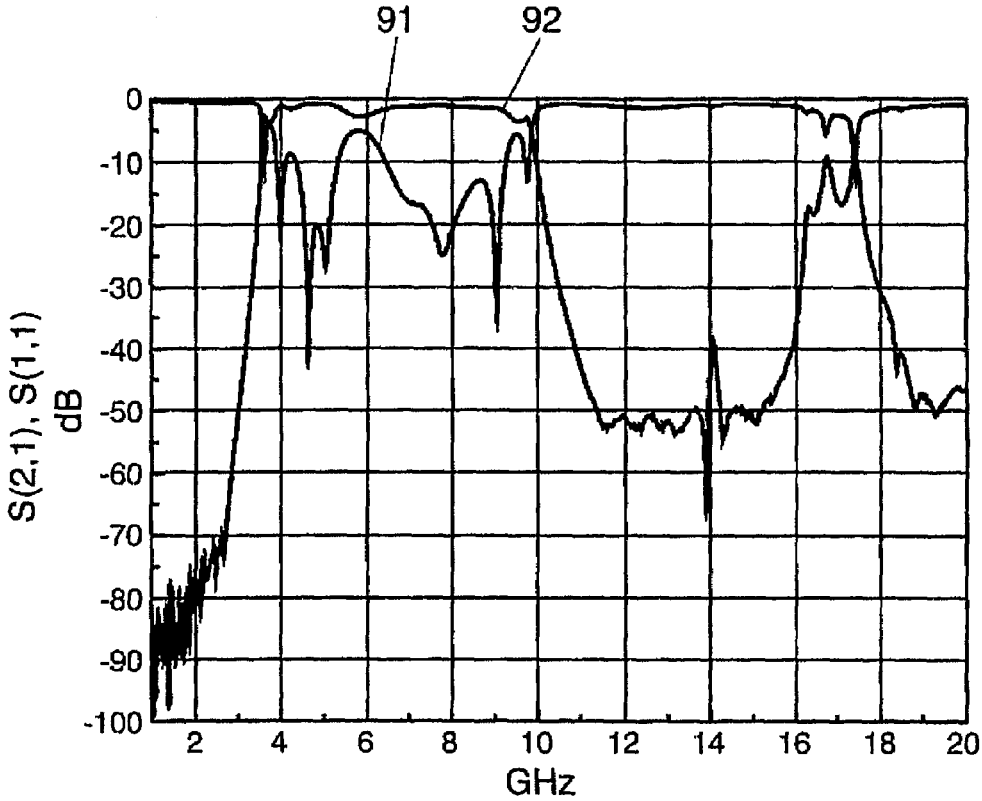

FIGS. 9*a* and 9*b* show a top view and measured frequency response of a passband filter based on the four filter cells as described above; FIG. 9*b* shows the reflection coefficient 91 and transmission coefficient 92. A passband covering the frequencies from approximately 4 GHz (lower −10 dB frequency limit) to approximately 10 GHz (upper −10 dB frequency limit) can be observed.

In this text, the term "comprises" and its derivations (such as "comprising", etc.) should not be understood in an excluding sense, that is, these terms should not be interpreted as excluding the possibility that what is described and defined may include further elements, steps, etc.

On the other hand, the invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

The invention claimed is:

1. A bandpass filter comprising:

a planar transmission medium comprising a transmission line, said transmission line comprising a conductor strip, said bandpass filter having, in said transmission line, at least one bandpass filter cell, said filter cell comprising at least one split-rings resonator, at least one inductive element and at least one capacitive element, said bandpass filter having a frequency response in which at least one passband can be identified, wherein said conductor strip, said at least one split-rings resonator, said at least one inductive element and said at least one capacitive element being dimensioned and arranged so that the bandpass filter, for frequencies within said passband, behaves as a left-handed transmission line for at least one range of frequencies within said passband, and as a right-handed transmission line for at least another range of frequencies within said passband, and wherein said at least one cell features a T equivalent circuit having a series impedance and a shunt impedance, wherein, for one frequency band within a passband of the bandpass filter, the series impedance of the cell is negative and the shunt impedance is positive, wherein, for another frequency band within the same passband, the series impedance of the cell is positive and the shunt impedance is negative, and wherein, at a frequency between said frequency bands, the series impedance is substantially null and the shunt impedance is substantially infinite.

2. The bandpass filter according to claim 1, wherein, within at least one of said two frequency bands, there is a frequency at which the Bloch impedance of the cell is matched with the impedance at the ports of the filter.

3. The bandpass filter according to claim 2, wherein, within both of said two frequency bands, there is a frequency at which the Bloch impedance of the cell is matched with the impedance at the ports of the filter.

4. The bandpass filter according to claim 3, wherein said Bloch impedance is matched to 50 Ohms.

5. The bandpass filter according to claim 2, wherein said Bloch impedance is matched to 50 Ohms.

6. The bandpass filter according to claim 1, wherein said at least one bandpass filter cell features three reflection zeros within the passband.

7. The bandpass filter according to claim 1, wherein said at least one split-rings resonator is a complementary split-rings resonator.

8. The bandpass filter according to claim 7, wherein the conductor strip further comprises at least one gap in said cell, said at least one gap constituting said capacitive element.

9. The bandpass filter according to claim 8, said at least one inductive element comprising at least one conducting stub situated in correspondence with said gap and connecting the conductor strip to a metal layer in which said at least one complementary split-rings resonator is formed, through a dielectric layer.

10. The bandpass filter according to claim 9, wherein said at least one complementary split-rings resonator comprises split rings etched in said metal layer on one side of said dielectric layer, and wherein said conductor strip is embodied on the other side of said dielectric layer, said at least one stub being arranged in correspondence with said at least one gap, said at least one stub being connected to the metal layer by vias through said dielectric layer.

11. The bandpass filter according to claim 10, said at least one gap comprising at least two gaps, said at least one stub comprising at least two stubs connected to the conductor strip between said two gaps.

12. The bandpass filter according to claim 10, wherein said metal layer is a ground plane of said transmission line.

13. The bandpass filter according to claim 9, said at least one gap comprising at least two gaps, said at least one stub comprising at least two stubs connected to the conductor strip between said two gaps.

14. The bandpass filter according to claim 13, wherein said metal layer is a ground plane of said transmission line.

15. The bandpass filter according to claim 9, wherein said metal layer is a ground plane of said transmission line.

16. The bandpass filter according to claim 1, wherein said at least one complementary split-rings resonator is etched in the conductor strip.

17. The bandpass filter according to claim 1, wherein said at least one split-rings resonator comprises non-metallic split rings established in at least one metal part of the transmission line.

18. The bandpass filter according to claim 1, wherein said at least one split-rings resonator is a metallic split-rings resonator, comprising metallic split rings, a magnetic coupling being provided between the conductor strip and said at least one split-rings resonator.

19. The bandpass filter according to claim 1, wherein said at least one split-rings resonator comprises split rings having a substantially circular shape.

20. The bandpass filter according to claim 1, wherein said at least one split-rings resonator comprises split rings having a substantially polygonal shape.

21. The bandpass filter according to claim 1, wherein said at least one passband features a fractional bandwidth of at least 20%, said fractional bandwidth being defined as $2*(fu-fl)/(fu+fl)$ where fu is an upper <10 dB frequency limit of the passband, and fl is a lower −10 dB frequency limit of the passband.

22. The bandpass filter according to claim 1, wherein said at least one passband has a bandwidth of at least 500 MHz between an upper and a lower −10 dB frequency limit of said passband.

23. The bandpass filter according to claim 1, wherein said at least one passband has a lower −10 dB frequency limit not above 4 GHz and an upper −10 dB frequency limit not below 9 GHz.

24. The bandpass filter according to claim 1, comprising a plurality of said filter cells, arranged in a cascade so that a transmitted signal passes through said plurality of filter cells.

25. The bandpass filter according to claim 1, embodied on a dielectric substrate having a thickness lower than 150 μm.

26. An electronic device, including at least one bandpass filter according to claim 1.

* * * * *